US009740154B2

(12) United States Patent
Tamura

(10) Patent No.: US 9,740,154 B2
(45) Date of Patent: Aug. 22, 2017

(54) IMAGE FORMING DEVICE AND PAPER DETERMINING METHOD

(71) Applicant: Konica Minolta, Inc., Chiyoda-ku, Tokyo (JP)

(72) Inventor: Nobuyasu Tamura, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/216,316

(22) Filed: Jul. 21, 2016

(65) Prior Publication Data

US 2017/0038710 A1 Feb. 9, 2017

(30) Foreign Application Priority Data

Aug. 4, 2015 (JP) ..... 2015-154068

(51) Int. Cl.
*G03G 15/00* (2006.01)
*G03G 15/20* (2006.01)

(52) U.S. Cl.
CPC ..... *G03G 15/5029* (2013.01); *G03G 15/2046* (2013.01)

(58) Field of Classification Search
CPC ..... G03G 15/2039; G03G 15/205; G03G 15/2078; G03G 2215/00772
USPC ..... 399/69, 60, 328, 329
See application file for complete search history.

(56) References Cited

U.S. PATENT DOCUMENTS 6,298,213 B1 * 10/2001 Miyamoto ..... G03G 15/2003 399/320
2013/0302058 A1 * 11/2013 Kimata ..... G03G 15/205 399/70
2014/0133880 A1 * 5/2014 Otsuka ..... G03G 15/2078 399/70

FOREIGN PATENT DOCUMENTS

JP 11-133801 A 5/1999
JP 2006-23329 1/2006
JP 2009-8778 1/2009

* cited by examiner

*Primary Examiner* — Walter L Lindsay, Jr.
*Assistant Examiner* — Jessica L Eley
(74) *Attorney, Agent, or Firm* — Squire Patton Boggs (US) LLP

(57) ABSTRACT

An image forming device includes: an image forming unit configured to form an image on paper fed from a paper housing unit; a heater lighting control unit configured to determine, based on a temperature detected by a temperature detecting unit in a fixing unit at least including a fixing roller that holds and carries the paper on which the image is formed, a pressure roller arranged in pressure-contact with the fixing roller, a heater that heats the fixing roller, and the temperature detecting unit arranged in a vicinity of the heater, a lighting rate of the heater; and a paper determination unit configured to determine information related to the paper based on lighting rates of the heater in standby and in printing which rates are determined by the heater lighting control unit.

10 Claims, 13 Drawing Sheets

FIG. 6

| HEATER RATING | APPLIED VOLTAGE | STATE OF FIXING DEVICE | Duty RATIO IN STANDBY | Duty RATIO IN PRINTING | | | DIFFERENCE IN PRINTING AND IN STANDBY | | |
|---|---|---|---|---|---|---|---|---|---|
| | | | | PLAIN PAPER | ROUGH PAPER | COATED PAPER | PLAIN PAPER | ROUGH PAPER | COATED PAPER |
| 200V | 200V | FIRST TIME IN MORNING | 25% | 60% | 51% | 69% | 35% | 26% | 44% |
| | | FIVE MINUTES AFTER FIRST TIME IN MORNING | 14% | 48% | 39% | 57% | 34% | 25% | 43% |
| | | FIFTEEN MINUTES AFTER FIRST TIME IN MORNING | 10% | 43% | 34% | 53% | 33% | 24% | 43% |
| | 180V | FIRST TIME IN MORNING | 30% | 66% | 55% | 74% | 36% | 25% | 44% |
| | | FIVE MINUTES AFTER FIRST TIME IN MORNING | 18% | 53% | 43% | 63% | 35% | 25% | 45% |
| | | FIFTEEN MINUTES AFTER FIRST TIME IN MORNING | 13% | 48% | 36% | 57% | 35% | 23% | 44% |
| | 220V | FIRST TIME IN MORNING | 21% | 56% | 46% | 65% | 35% | 25% | 44% |
| | | FIVE MINUTES AFTER FIRST TIME IN MORNING | 10% | 45% | 35% | 53% | 35% | 25% | 43% |
| | | FIFTEEN MINUTES AFTER FIRST TIME IN MORNING | 7% | 40% | 31% | 49% | 33% | 24% | 42% |
| | | | | | | AVERAGE VALUE → | 35% | 25% | 44% |

FIG. 7

| HEATER RATING | APPLIED VOLTAGE | STATE OF FIXING DEVICE | Duty RATIO IN STANDBY | Duty RATIO IN PRINTING | | DIFFERENCE IN PRINTING AND IN STANDBY | |
|---|---|---|---|---|---|---|---|
| | | | | PLAIN PAPER [80g/m$^2$] | PLAIN PAPER [120g/m$^2$] | PLAIN PAPER [80g/m$^2$] | PLAIN PAPER [120g/m$^2$] |
| 200V | 200V | FIRST TIME IN MORNING | 25% | 60% | 87% | 35% | 62% |
| | | FIVE MINUTES AFTER FIRST TIME IN MORNING | 14% | 48% | 77% | 34% | 63% |
| | | FIFTEEN MINUTES AFTER FIRST TIME IN MORNING | 10% | 43% | 71% | 33% | 61% |
| | 180V | FIRST TIME IN MORNING | 30% | 66% | 93% | 36% | 63% |
| | | FIVE MINUTES AFTER FIRST TIME IN MORNING | 18% | 53% | 78% | 35% | 60% |
| | | FIFTEEN MINUTES AFTER FIRST TIME IN MORNING | 13% | 48% | 74% | 35% | 61% |
| | 220V | FIRST TIME IN MORNING | 21% | 56% | 84% | 35% | 63% |
| | | FIVE MINUTES AFTER FIRST TIME IN MORNING | 10% | 45% | 72% | 35% | 62% |
| | | FIFTEEN MINUTES AFTER FIRST TIME IN MORNING | 7% | 40% | 67% | 33% | 60% |
| | | | | | AVERAGE VALUE → | 35% | 62% |

IMAGE FORMING DEVICE AND PAPER DETERMINING METHOD

The entire disclosure of Japanese Patent Application No. 2015-154068 filed on Aug. 4, 2015 including description, claims, drawings, and abstract are incorporated herein by reference in its entirety.

BACKGROUND OF THE INVENTION

Field of the Invention

The present invention relates to an image forming device that includes a fixing device including a heater, and a paper determining method of determining fed paper.

Description of the Related Art

In recent years, it becomes necessary for an image forming device to correspond to various kinds of paper due to diversification of media. Specifically, it is desired to correspond to paper with high smoothness such as coated paper or paper with extremely low smoothness such as rough paper. In order to correspond to these kinds of paper, it is necessary to set a parameter for each kind of paper and to control a printing operation. Thus, a unit of automatically detecting a kind of paper becomes necessary for an image forming device.

As an example, a technology of estimating electric energy consumed by a heater of a fixing device in an arbitrary period by measuring current flowing in the heater and voltage applied thereto, of detecting a kind of paper based on the power consumption, and of controlling a paper carrying interval or a lighting rate of the heater is known (see JP 11-133801 A). According to the technology described in JP 11-133801 A, it is possible to perform determination of a weight difference between pieces of paper and determination of rough paper or the like by measuring power consumption during continuous printing.

As a different example, a technology of determining a kind of paper from a temperature detected by a temperature sensor in a case where printing is performed in a prescribed on/off interval of a heater in the beginning of a job, setting a target fixation temperature according to the kind of paper, and controlling the heater to keep a fixation temperature of a fixing member at the target fixation temperature is known (see JP 2006-23329 A). According to the technology described in JP 2006-23329 A, it is possible to perform printing in a prescribed on/off interval of a heater in the beginning of the printing and to detect grammage of paper based on a temperature detected by a temperature sensor.

As a different example, a technology of determining a printing condition (plain paper mode or gloss mode) based on a kind of paper detected by utilization of an LED and a sensor and a printing rate calculated by a printing rate calculation unit is known (see JP 2009-8778 A). According to the technology described in JP 2009-8778 A, a transmittance and glossiness of paper are measured with an LED and a sensor and detection of grammage of paper and detection of coated paper or the like are performed.

However, in the technology described in JP 11-133801 A, power consumption varies depending on a state of a fixing device during continuous printing. Thus, it is difficult to determine a kind of paper accurately. Further, a unit of measuring current and voltage is necessary and a cost is increased.

In the technology described in JP 2006-23329 A, it is not possible to determine how much a fixing member is warmed and to determine a state of a power supply. Thus, it is not possible to determine grammage of paper accurately. In addition, in the technology described in JP 2006-23329 A, smoothness of paper is not detected.

In the technology described in JP 2009-8778 A, a kind of paper is detected based on a transmittance and glossiness. Thus, it is difficult to perform a detailed detection such as detection of a basis weight difference in thick paper or detection of rough paper. In addition, since it is necessary to provide an LED and a sensor, a cost is increased.

SUMMARY OF THE INVENTION

Because of the above condition, a method of making it possible to detect information related to paper (such as smoothness) accurately regardless of a state of a fixing device has been desired.

To achieve the abovementioned object, according to an aspect, an image forming device reflecting one aspect of the present invention comprises: an image forming unit configured to form an image on fed paper; a heater lighting control unit; and a paper determination unit.

The heater lighting control unit is configured to determine, based on a temperature detected by a temperature detecting unit in a fixing unit at least including a fixing roller that holds and carries the paper on which the image is formed, a pressure roller arranged in pressure-contact with the fixing roller, a heater that heats the fixing roller, and the temperature detecting unit arranged in a vicinity of the heater, a lighting rate of the heater.

The paper determination unit is configured to determine information related to the paper based on lighting rates of the heater in standby and in printing which rates are determined by the heater lighting control unit.

To achieve the abovementioned object, according to an aspect, an image forming device reflecting one aspect of the present invention comprises: an image forming unit configured to form an image on fed paper; a heater lighting control unit; a voltage measurement unit; a heater power consumption calculation unit; and a paper determination unit.

The heater lighting control unit is configured to determine, based on a temperature detected by a temperature detecting unit in a fixing unit including a fixing roller that holds and carries the paper on which the image is formed, a pressure roller that is arranged in pressure-contact with the fixing roller, a heater that heats the fixing roller, and the temperature detecting unit arranged in a vicinity of the heater, a lighting rate of the heater.

The voltage measurement unit is configured to measure a voltage applied to the heater.

The heater power consumption calculation unit is configured to calculate power consumed by the heater in standby and in printing based at least on the voltage applied to the heater and the lighting rate of the heater which rate is determined by the heater lighting control unit.

The paper determination unit is configured to determine information related to the paper based on power consumption of the heater in standby and in printing which power consumption is calculated by the heater power consumption calculation unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 6 is a view illustrating a verification result with respect to a plurality of kinds of paper with substantially-identical grammage;

FIG. 7 is a view illustrating a verification result with respect to a plurality of pieces of plain paper with different grammage;

DESCRIPTION OF THE PREFERRED EMBODIMENTS

Hereinafter, an embodiment of the present invention will be described with reference to the drawings. However, the scope of the invention is not limited to the illustrated examples. Note that the same sign is assigned to configuration elements having a substantially-identical function or configuration in each drawing and an overlapped description is omitted.

<1. First Embodiment>

[Whole Configuration of Image Forming Device]

Figure 1:
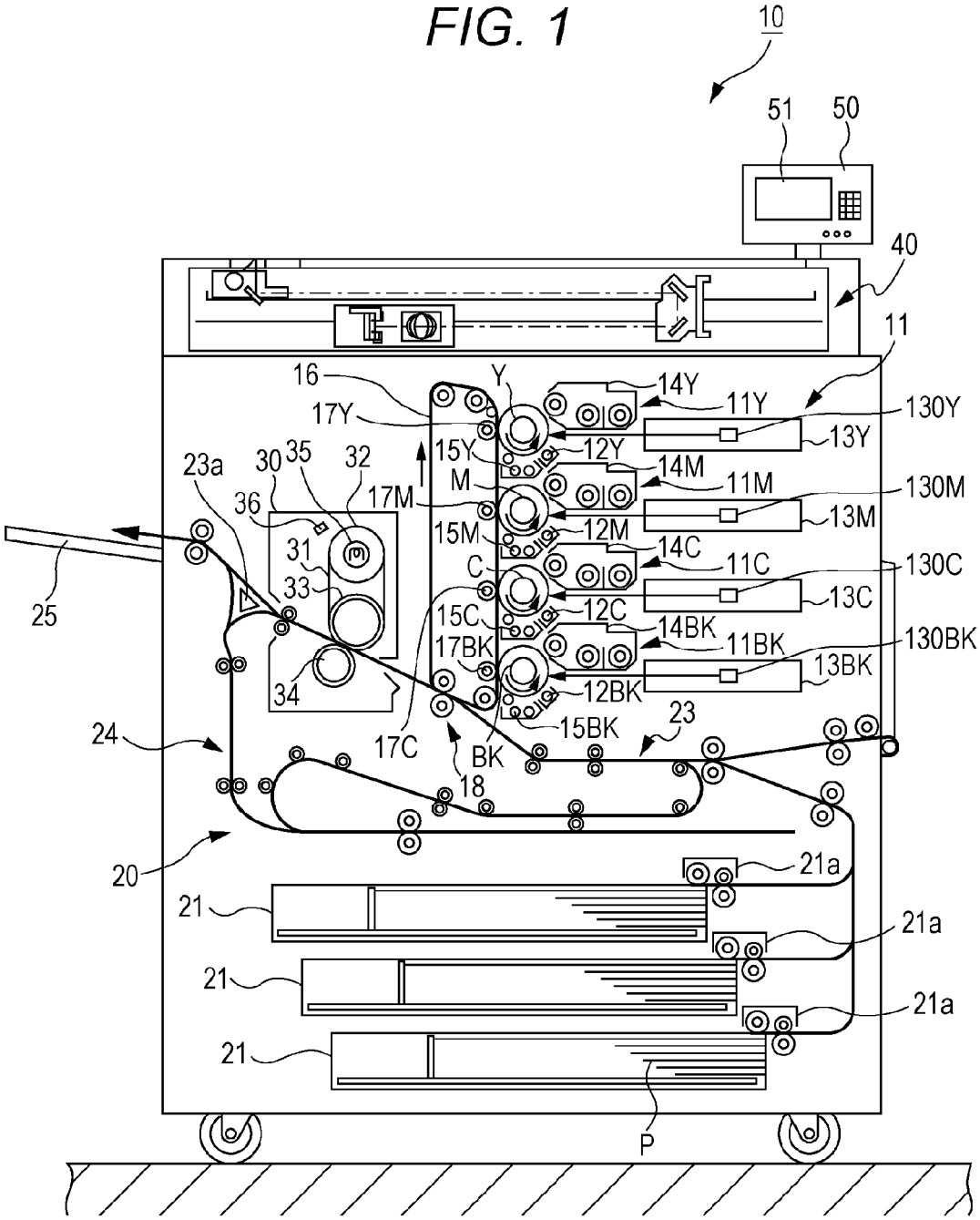
FIG. 1 is a whole configuration view illustrating an example of an image forming device to which an embodiment of the present invention is applied.

FIG. 1 is a whole configuration view illustrating an example of an image forming device to which an embodiment of the present invention is applied. In FIG. 1, an element considered to be necessary for a description of an embodiment of the present invention and an element related thereto are illustrated and an image forming device is not limited to this example.

An image forming device 10 of the first embodiment detects information related to paper based on lighting rates of a heater in standby and in printing (in image forming), which rates are determined by a control device that determines a lighting rate of a heater in a fixing device, and gives a feedback to a control parameter. The information related to paper is, for example, smoothness and grammage.

The image forming device 10 is an electrophotographic image forming device such as a copier. The image forming device 10 is a so-called tandem-type color image forming device that forms a full-color image by an array of a plurality of photoreceptors in a vertical direction in a manner facing one intermediate transfer belt.

The image forming device 10 includes an image forming unit 11, a paper carrying unit 20, a fixing device 30, a manuscript reading unit 40, and an operation display unit 50.

The image forming unit 11 is an example of an image forming unit and includes an image forming unit 11Y that forms a yellow (Y) image, an image forming unit 11M that forms a magenta (M) image, an image forming unit 11C that forms a cyan (C) image, and an image forming unit 11BK that forms a black (BK) image.

The image forming unit 11Y includes a photoreceptor drum Y, a charging unit 12Y arranged therearound, an optical writing unit 13Y including a laser diode 130Y, a developing device 14Y, and a drum cleaner 15Y. Similarly, the image forming units 11M, 11C, and 11BK respectively include photoreceptor drums M, C, and BK, charging units 12M, 12C, and 12BK arranged therearound, optical writing units 13M, 13C, and 13BK including laser diodes 130M, 130C, and 130BK, developing devices 14M, 14C, and 14BK, and drum cleaners 15M, 15C, and 15BK.

A surface of the photoreceptor drum Y is energized uniformly by the charging unit 12Y. By scanning exposure with the laser diode 130Y of the optical writing unit 13Y, a latent image is formed on the photoreceptor drum Y. Moreover, the developing device 14Y develops the latent image on the photoreceptor drum Y by performing the development with toner. Accordingly, on the photoreceptor drum Y, an image (toner image) in a predetermined color corresponding to yellow is formed.

Similarly, a surface of the photoreceptor drum M is energized uniformly by the charging unit 12M. By scanning exposure with the laser diode 130M of the optical writing unit 13M, a latent image is formed on the photoreceptor drum M. Moreover, the developing device 14M develops the latent image on the photoreceptor drum M by performing the development with toner. Accordingly, on the photoreceptor drum M, a toner image in a predetermined color corresponding to magenta is formed.

A surface of the photoreceptor drum C is energized uniformly by the charging unit 12C. By scanning exposure with the laser diode 130C of the optical writing unit 13C, a latent image is formed on the photoreceptor drum C. Moreover, the developing device 14C develops the latent image on the photoreceptor drum C by performing the development with toner. Accordingly, on the photoreceptor drum C, a toner image in a predetermined color corresponding to cyan is formed.

A surface of the photoreceptor drum BK is energized uniformly by the charging unit 12BK. By scanning exposure with the laser diode 130BK of the optical writing unit 13BK, a latent image is formed on the photoreceptor drum BK. Moreover, the developing device 14BK develops the latent image on the photoreceptor drum BK by performing the development with toner. Accordingly, on the photoreceptor drum BK, a toner image in a predetermined color corresponding to black is formed.

The toner images formed on the photoreceptor drums Y, M, C, and BK are successively transferred to predetermined positions on an intermediate transfer belt 16, which is an endless intermediate transfer body, by primary transfer rollers 17Y, 17M, 17C, and 17BK. The toner image in each color which image is transferred onto the intermediate transfer belt 16 is transferred to paper P, which is carried by the paper carrying unit 20 at predetermined timing, by a secondary transfer unit 18.

On a side of ejecting paper in the secondary transfer unit 18, the fixing device 30 (example of fixing unit) is provided. The fixing device 30 presses and heats the paper P and fixes the transferred toner image on the paper P. The fixing device 30 includes a heating member and a pressure member. The heating member includes a heating roller 32, an upper pressure roller 33 (example of fixing roller), and an endless fixing belt 31 that is stretched by the two rollers and driven circularly. The pressure member includes a lower pressure roller 34 (example of pressure roller) that presses (is in pressure-contact with) the upper pressure roller 33 via the fixing belt 31. The heating roller 32 includes a heater 35 as a heat source that heats the fixing belt 31. The upper pressure roller 33 and the lower pressure roller 34 are formed in a manner contactable/separable with respect to each other. At a position where the upper pressure roller 33 and the lower pressure roller 34 are in contact with each other, a fixing nip part is formed as a pressure-contact part.

By radiant heat from the heater 35 provided inside the heating roller 32, an outer peripheral part of the heating roller 32 is wormed up. Then, the heat of the heating roller 32 is transmitted to paper via the fixing belt 31. Thus, a toner image on the paper P is thermally fixed.

Near the heating roller 32 of the fixing device 30, a temperature sensor 36 (example of temperature detecting unit) that outputs an electric signal corresponding to a detected temperature is arranged. Since fed paper passes through a center part in an axial direction of the heating roller 32 regardless of a size of the paper, the temperature sensor 36 is preferably arranged in the vicinity of the center part in the axial direction of the heating roller 32. Further, when temperature sensors are arranged in an end part and the center part in the axial direction of the heating roller 32, a temperature detected by the temperature sensor arranged at the center part is used.

The manuscript reading unit 40 performs scanning exposure of an image of a manuscript with an optical system of a scanning exposure device, reads reflection light therefrom with a line image sensor, and acquires an image signal. Note that the image forming device 10 may include a configuration in which an automatic manuscript feeding device (not illustrated) that feeds a manuscript is included in an upper part.

The operation display unit 50 includes a liquid crystal display (LCD) 51, a touch panel provided in such a manner as to cover the LCD 51, various switches or buttons, a numeric keypad, an operation key group, and the like. The operation display unit 50 receives an instruction from a user and outputs an operation signal thereof to a control device 100 that will be described later (see FIG. 2). Further, according to a display signal input from the control device 100, the operation display unit 50 displays, on the LCD 51, an operation screen of displaying various setting screens for inputting various operation instructions or setting information, various processing results, or the like.

The paper carrying unit 20 includes a plurality of paper feed trays 21 housing the paper P, and a paper feeding unit 21*a* that delivers the paper P housed in the paper feed trays 21. Further, the paper carrying unit 20 includes a main carriage path 23 in which the paper P delivered from the paper feed trays 21 is carried, a reversal carriage path 24 that reverses sides of the paper P, and a paper ejection tray 25 to which the paper P is ejected.

In the paper carrying unit 20, the reversal carriage path 24 branches from the main carriage path 23 on a downstream side of the fixing device 30. At a place where the reversal carriage path 24 branches from the main carriage path 23, a switching gate 23*a* is included. In the image forming device 10, on an upper surface of the paper P that is carried in the main carriage path 23 and that passes through the secondary transfer unit 18 and the fixing device 30, an image is formed. In a case where images are formed on both sides of the paper P, the paper P with an image being formed on one surface facing upward is carried from the main carriage path 23 to the reversal carriage path 24. Then, the paper P is carried from the reversal carriage path 24 to the main carriage path 23. Thus, the surface on which the image is formed faces downward. Accordingly, sides of the paper P are reversed and it becomes possible to form an image on the other surface facing upward.

[Control System of Image Forming Device]

Next, a control system of the image forming device 10 will be described with reference to FIG. 2.

Figure 2:
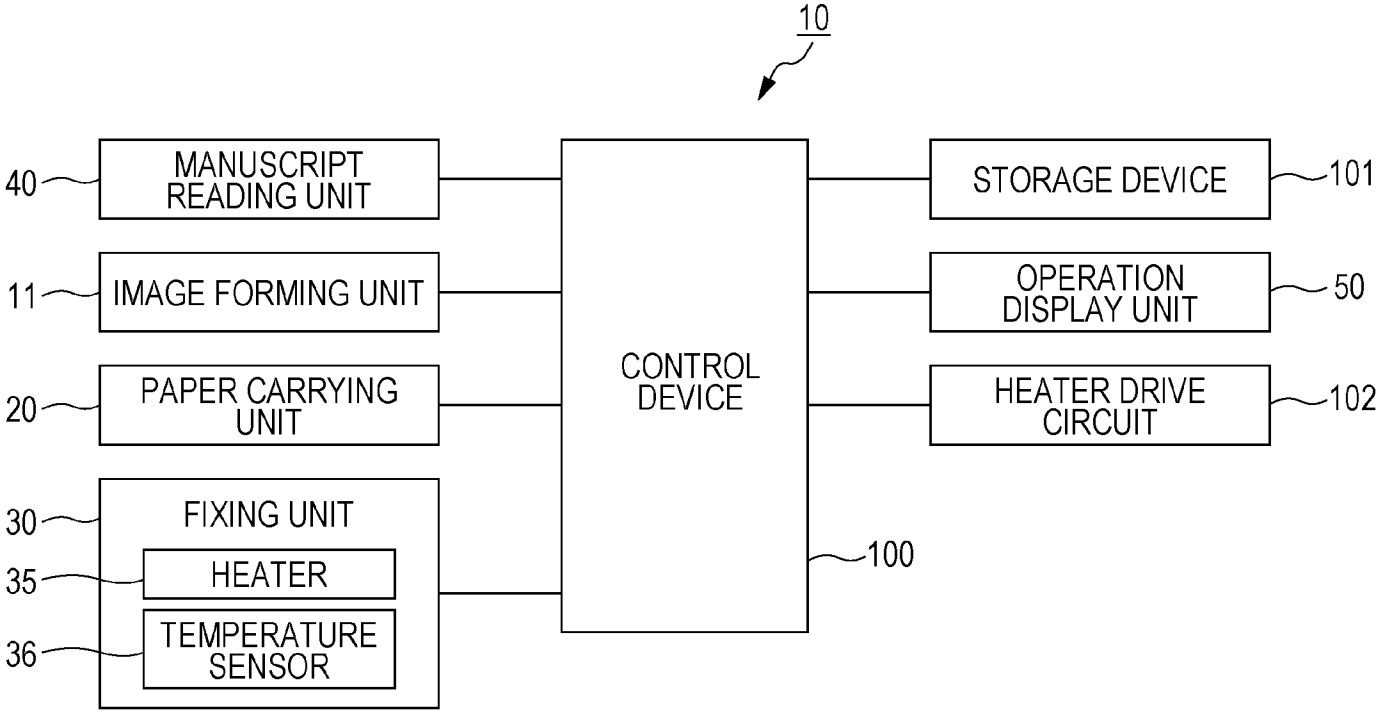
FIG. 2 is a block diagram illustrating a control system of the image forming device in FIG. 1.

FIG. 2 is a block diagram illustrating a control system of the image forming device 10. In FIG. 2, an element considered to be necessary for a description of an embodiment of the present invention and an element related thereto are illustrated and a control system of an image forming device is not limited to this example.

The image forming device 10 includes the control device 100 (example of control unit) that performs a series of control of feeding the paper P, forming an image, and ejecting the paper, and a storage device 101. The control device 100 includes a calculation processing device including a central processing unit (CPU), and a memory such as a random access memory (RAM) or a read only memory (ROM). The ROM stores a program executed by the CPU of the control device 100, data used in execution of the program, and the like. Instead of the CPU, a micro-processing unit (MPU) may be used.

The storage device 101 is an example of a storage unit and stores a parameter used by the CPU of the control device 100 in execution of a program, data acquired by execution of the program, and the like. For example, the storage device 101 stores paper setting or screen data illustrated in FIG. 9 and FIG. 10, a toner deposition amount property illustrated in FIG. 12, and the like. The storage device 101 may store a program executed by the CPU of the control device 100.

A normal operation performed by the image forming device 10 to form an image on the paper P (printing operation) will be described. The control device 100 controls the paper carrying unit 20 and carries the paper P. The control device 100 controls the image forming unit 11 based on image data acquired from a manuscript in the manuscript reading unit 40 or image data acquired from the outside and forms an image on the paper P. Further, the control device 100 controls the fixing device 30 to fix the image on the paper P and ejects the paper P on which the image is formed.

The control device 100 outputs a control signal to a heater drive circuit 102 based on paper setting or a result of determination of paper. The heater drive circuit 102 supplies a drive signal (supply current) to the heater 35 according to the control signal and turns on the heater 35. When no drive signal is supplied, the heater 35 is turned off. Further, the control device 100 acquires a measurement result (detected temperature) from the temperature sensor 36.

[Heater Control and Paper Detection Control (PID Control)]

Next, an example of the heater control and the paper detection control will be described.

Figure 3:
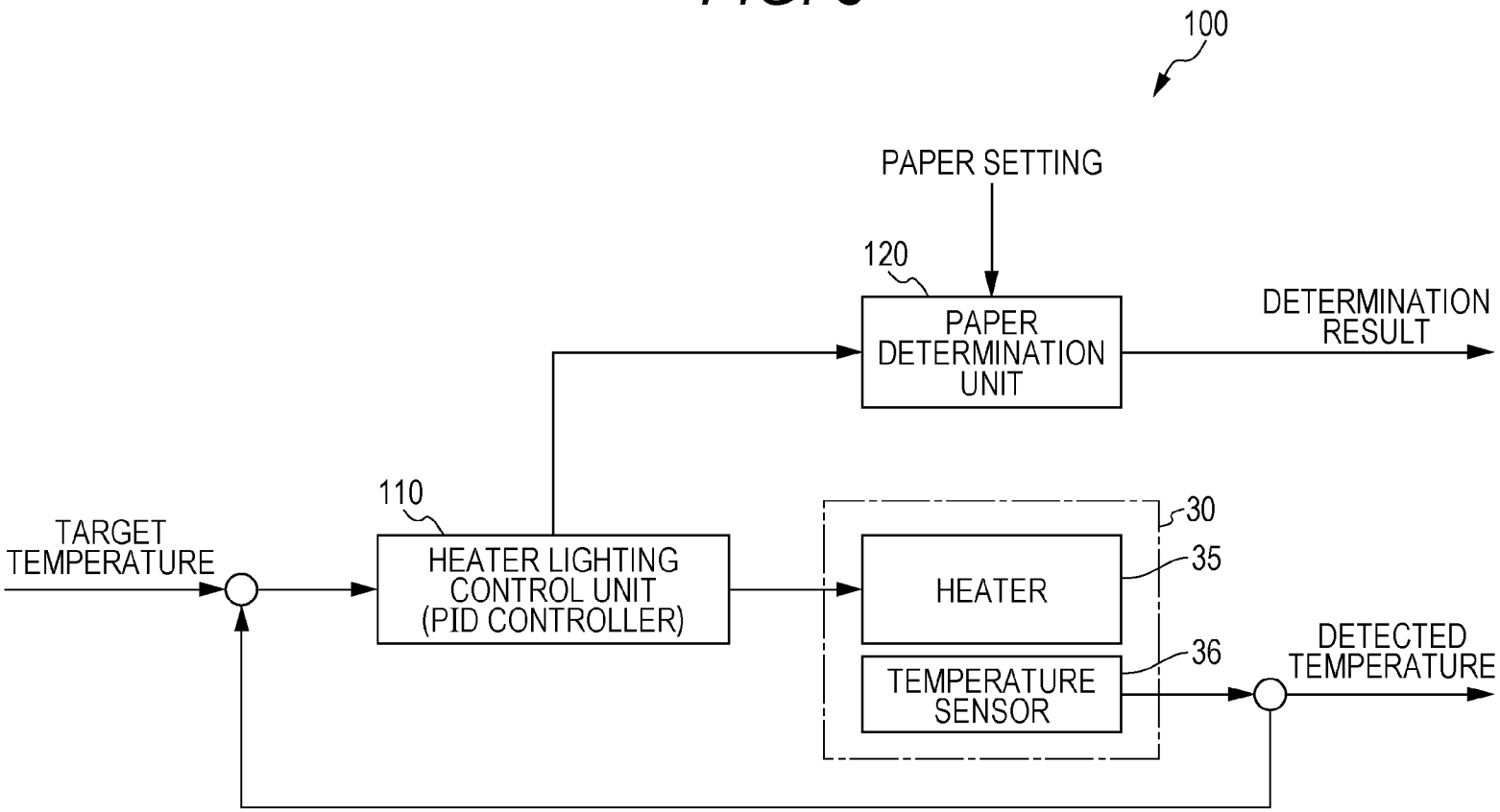
FIG. 3 is a block diagram illustrating a flow of heater lighting control and paper detection control in a control device according to a first embodiment.

FIG. 3 is a block diagram illustrating a flow of heater lighting control and paper detection control in the control device 100. The flow of the heater lighting control and the paper detection control illustrated in FIG. 3 is an example in a case where lighting control of the heater 35 is performed by the PID control.

The control device 100 includes a heater lighting control unit 110 and a paper determination unit 120. The heater lighting control unit 110 includes a PID controller. Based on a deviation between a target temperature of the heater 35 and a temperature detected by the temperature sensor 36, the heater lighting control unit 110 estimates a lighting rate of the heater 35 by the PID control. Then, the heater lighting control unit 110 outputs a control signal to the heater drive circuit 102 (FIG. 2) based on the estimated lighting rate of the heater 35 and controls lighting of the heater 35. The target temperature is previously stored in the ROM in the control device 100 or the storage device 101.

The heater lighting control unit 110 estimates a lighting rate of the heater 35 from a target temperature and a detected temperature. A heater lighting rate is a percentage of an on period to the sum of the on period and an off period of the heater (duty ratio). The heater lighting rate is expressed by an expression (1) in a case of the PID control. The heater lighting control unit 110 calculates lighting rates of the heater 35 in standby and in printing and outputs the rates to the paper determination unit 120.

$$\text{Heater lighting rate} = Kp\times(\text{deviation}) + Ki\times(\text{accumulated deviation}) + Kd\times(\text{current deviation} - \text{previous deviation}) \quad (1)$$

Kp: coefficient of term proportional to deviation

Ki: coefficient of term integrating deviation

Kd: coefficient of term differentiating deviation deviation: target temperature−detected temperature With respect to paper with high smoothness, adhesiveness between the fixing belt 31 and the paper becomes high and a quantity of heat transmitted to the paper in passing of the paper is increased. With respect to rough paper, adhesiveness between the fixing belt 31 and the paper is decreased due to roughness and a quantity of heat transmitted to the paper in passing of the paper is decreased. Further, since heat is not supplied much to a recessed part on a surface of the rough paper, fixing failure may be generated. Moreover, immediately after activation of a power supply in an environment in a low temperature, a device (fixing device 30) and paper are cool. Thus, more heat is consumed.

The paper determination unit 120 determines information related to paper (such as smoothness or grammage) based on heater lighting rates in standby and in printing which rates are input from the heater lighting control unit 110 and paper setting. The grammage is a basis weight in a unit area of paper. The information related to paper is a material of determination in specification of a kind of paper. Contents determined in the paper determination unit 120 (determination result) is fed back to a control parameter of the control device 100. Note that contents of paper setting will be described with reference to FIG. 5.

In the PID control, a lighting rate of the heater 35 is estimated. Thus, a period necessary until a lighting rate of the heater 35 is determined in the PID control is shorter than that in on/off control and hysteresis control described later. Thus, compared to a different control system, a period until information related to paper is determined is short in the PID control.

[Modification Example of Heater Control and Paper Detection Control (On/Off Control)]

Next, a modification example of heater control and paper detection control will be described.

Figure 4:
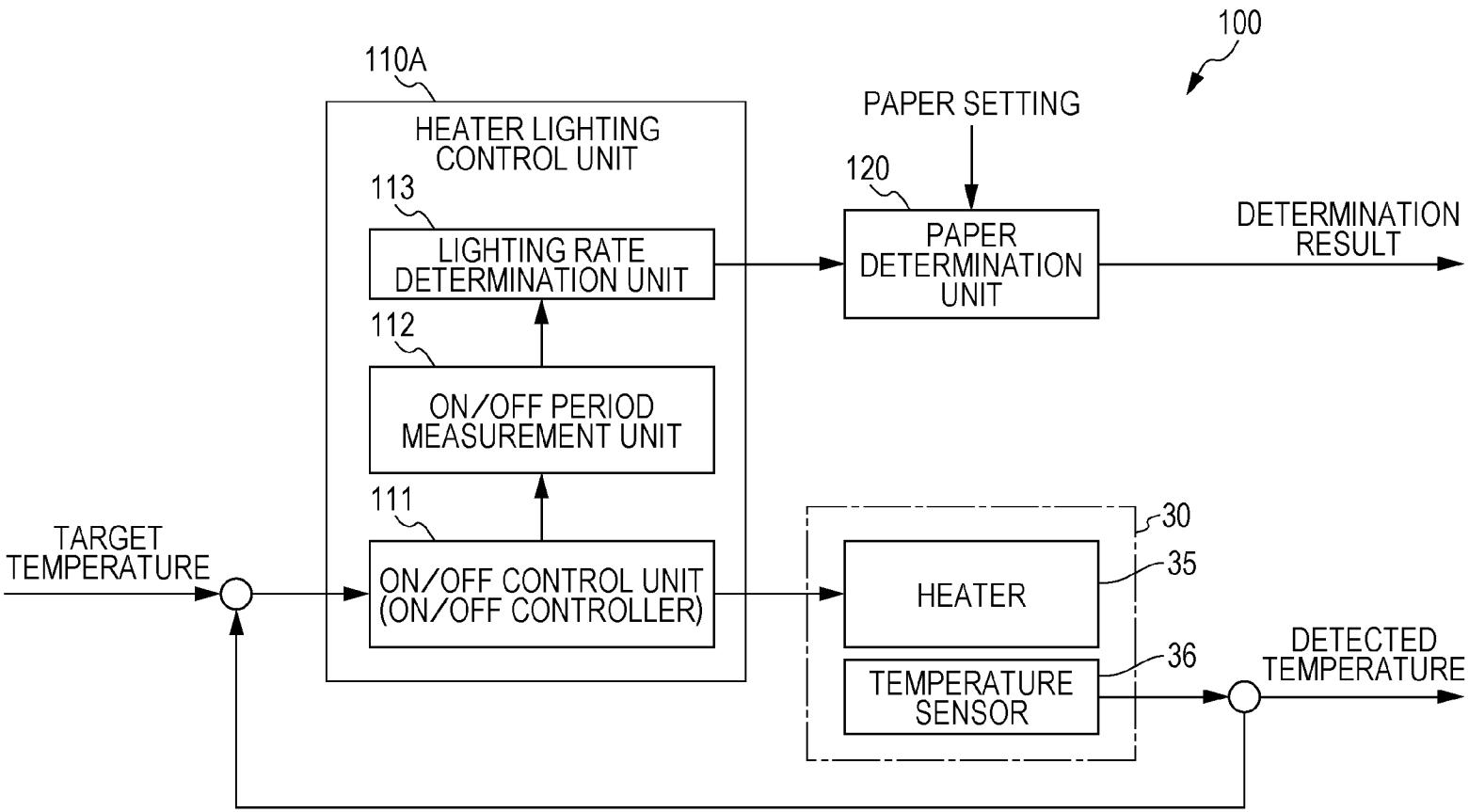
FIG. 4 is a block diagram illustrating a modification example of a flow of heater lighting control and paper detection control in the control device according to the first embodiment.

FIG. 4 is a block diagram illustrating a modification example of a flow of heater lighting control and paper detection control in a control device 100. The flow of the heater lighting control and the paper detection control illustrated in FIG. 4 is an example of a case where lighting control of a heater 35 is performed by on/off control instead of PID control.

A control device 100 illustrated in FIG. 4 includes a heater lighting control unit 110A and a paper determination unit 120. The heater lighting control unit 110A includes an on/off control unit 111, an on/off period measurement unit 112, and a lighting rate determination unit 113.

The on/off control unit 111 performs control of turning on a heater 35 when a temperature detected by a temperature sensor 36 becomes equal to or lower than a target temperature and of turning of the heater 35 when the temperature detected by the temperature sensor 36 exceeds the target temperature.

The on/off period measurement unit 112 measures an on period and an off period of the heater 35 controlled by the on/off control unit 111. The on/off period measurement unit 112 measures a period based on a clock frequency of a CPU of the control device 100 and the number of clock signals in each period. Alternatively, a timer may be used as the on/off period measurement unit 112.

The lighting rate determination unit 113 determines a lighting rate of the heater 35 from the on period and off period of the heater 35, which periods are measured by the on/off period measurement unit 112, and outputs the rate to the paper determination unit 120. Note that in the on/off control or PID control, thresholds may be provided above/below a target temperature to include a certain range (target temperature $\pm\alpha$) in the target temperature.

[Different Modification Example of Heater Control and Paper Detection Control (Hysteresis Control)]

Next, a different modification example of heater control and paper detection control will be described.

In FIG. 4, a hysteresis control unit (not illustrated) may be used instead of an on/off control unit 111. In the hysteresis control, an upper limit value and a lower limit value are provided with respect to a target temperature. The hysteresis control unit performs control of turning off a heater 35 when a temperature detected by the temperature sensor 36 exceeds the upper limit value and of turning on the heater 35 when the temperature detected by the temperature sensor 36 becomes equal to or lower than the lower limit value. Then, similarly to the on/off control, an on period and an off period of the heater 35 are measured by an on/off period measurement unit 112 and a lighting rate of the heater 35 is determined by a lighting rate determination unit 113 from the on period and off period.

In the on/off control and hysteresis control, since it takes time until the on period and the off period become stable, it takes long time until a lighting rate of the heater 35 is determined compared to the PID control.

[Processing of Determining Information Related to Paper]

Figure 5:
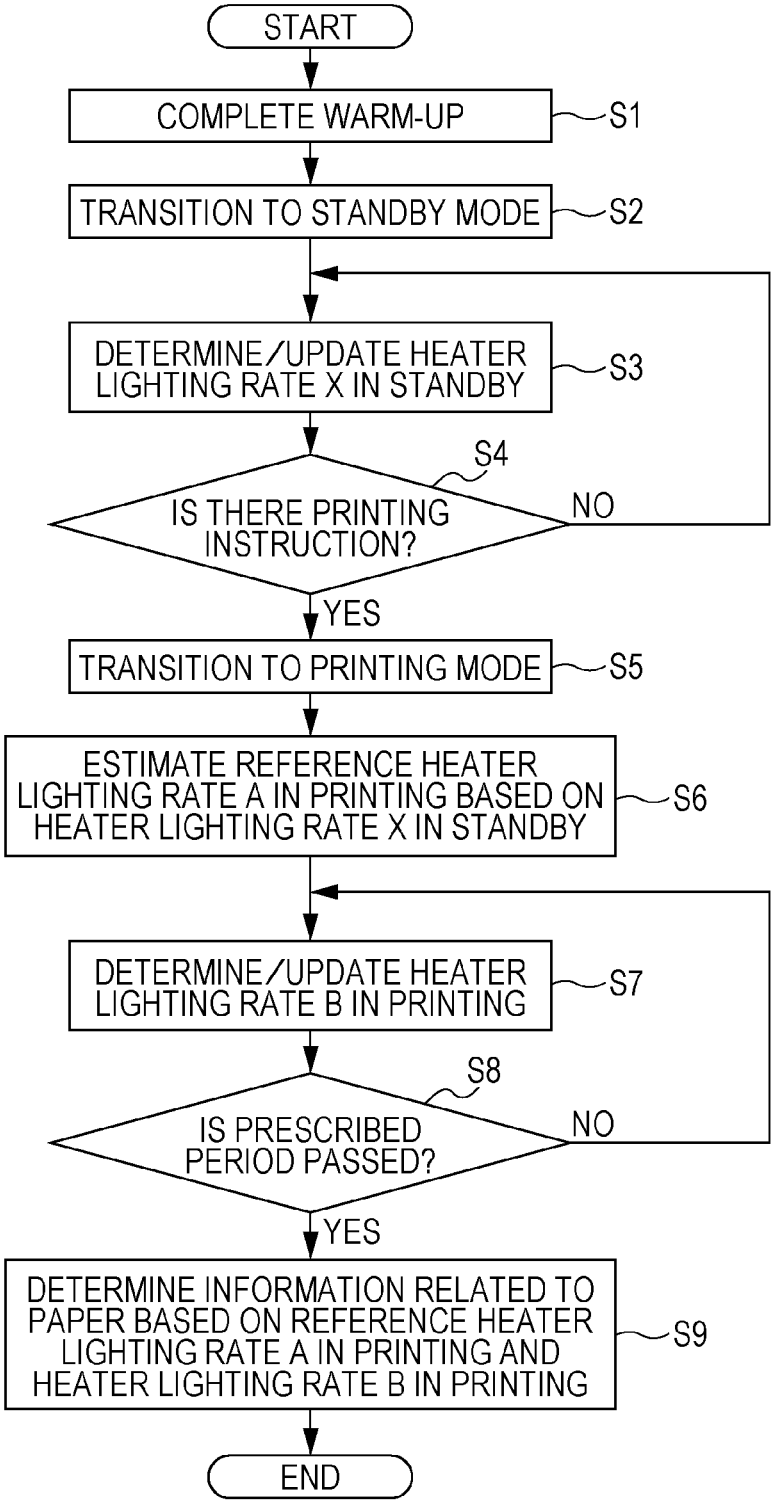
FIG. 5 is a flowchart illustrating an example of information determination processing related to paper according to the first embodiment.

FIG. 5 is a flowchart illustrating an example of information determination processing related to paper which processing is performed by a control device. A CPU of each of the control devices 100 and 100A realizes the processing illustrated in FIG. 5 by executing a program stored in a ROM or the like. In the following, a description will be made with reference to the control device 100.

First, the control device 100 starts warming up when detecting that a power button (not illustrated) of the image forming device 10 or the operation display unit 50 is operated. In the warming up, the control device 100 controls lighting of the heater 35 in such a manner that the heating roller 32 of the fixing device 30 is warmed up. Then, the control device 100 completes the warming up when a temperature detected by the temperature sensor 36 becomes a set temperature (S1)

Then, the control device 100 makes the image forming device 10 transition into a standby mode (S2). In the standby mode, the control device 100 controls lighting of the heater 35 in such a manner that the heating roller 32 is kept at a predetermined temperature.

Then, the heater lighting control unit 110 of the control device 100 determines a lighting rate X of the heater 35 in standby in each certain period and temporarily stores the rate in a RAM. That is, a lighting rate X is determined in each certain period and written into the RAM and information of the lighting rate X is updated (S3). The control device 100 may store lighting rate into an inner memory (so-called cache memory) in the CPU instead of the RAM.

Then, the heater lighting control unit 110 determines whether there is a printing instruction (S4). When there is no printing instruction (NO in S4), the heater lighting control unit 110 goes to the processing in step S3 and keeps performing the processing of determining and updating the lighting rate X of the heater 35.

On the other hand, when there is a printing instruction (YES in S4), the control device 100 transitions into a printing mode of executing a job (S5). In the printing mode, the control device 100 acquires a temperature detected by the temperature sensor 36 and executes a printing operation while controlling the lighting of the heater 35 in such a manner that the detected temperature of the fixing device 30 is kept at a target temperature.

Next, the paper determination unit 120 of the control device 100 estimates a reference lighting rate A (estimated value of lighting rate) of the heater 35 in printing based on paper setting in a paper feed tray 21 and the lighting rate X of the heater 35 in standby (S6). For example, the reference lighting rate A is estimated by utilization of a predetermined function F expressed by an expression (2). Paper setting is, for example, an intermediate value in a grammage band of a paper feed tray and the number of pieces of paper passing in a minute. Here, since various expressions can be applied to the function F, a detailed description thereof is omitted.

$$\text{Reference lighting rate } A=F(X,Y,\text{PPM}) \quad (2)$$

Here, Y: intermediate value in grammage band of paper feed tray

PPM: number of pieces of paper passing in one minute

Note that the reference lighting rate A of the heater 35 in printing may be set by utilization of a table to which the lighting rate X of the heater 35 in standby, the intermediate value Y in the grammage band of the paper feed tray, and the PPM are associated instead of utilization of a function.

Next, the heater lighting control unit 110 determines a lighting rate B of the heater 35 in printing in each certain period and temporarily stores the rate into the RAM. That is, a lighting rate B is determined in each certain period and written into the RAM and information of the lighting rate B is updated (S7).

Then, the heater lighting control unit 110 determines whether a prescribed period passes (S8). When the prescribed period is not yet passed (NO in S8), the heater lighting control unit 110 goes to the processing in step S7 and keeps performing the processing of determining the lighting rate B of the heater 35. The prescribed period is a period after the image forming device 10 starts printing and until a temperature detected by the temperature sensor 36 becomes a target temperature. Alternatively, instead of the prescribed period, a period until a difference (deviation) between a detected temperature and a target temperature becomes a target deviation may be prescribed.

On the other hand, when the prescribed period passes (YES in S8), the paper determination unit 120 determines information related to paper housed in a selected paper feed tray 21 based on the reference lighting rate A of the heater 35 in printing and the lighting rate B of the heater 35 in printing (S9). Then, the control device 100 ends information determination processing related to paper.

For example, the paper determination unit 120 compares the reference lighting rate A of the heater 35 in printing and the lighting rate B of the heater 35 in printing and determines smoothness as information related to paper. When the lighting rate B is higher than the reference lighting rate A (B>A), the paper determination unit 120 determines that paper housed in the paper feed tray 21 is paper having higher smoothness than paper that is an object of paper setting (standard paper) in the paper feed tray 21. Further, when the lighting rate B is equal to or lower than the reference lighting rate A (B≤A), the paper determination unit 120 determines that paper housed in the paper feed tray 21 is paper having lower smoothness than the standard paper.

[Verification Result (Plurality of Kind of Paper Having Substantially-identical Grammage)]

Then, a lighting rate (duty ratio) of the heater 35 in a case where printing on plain paper, rough paper, and coated paper having substantially-identical grammage is performed is verified. The plain paper is generally used in an image forming device. The rough paper is paper having a rough surface and lower smoothness than the plain paper. The coated paper is paper that has a gloss formed by putting of a paint, in which a white pigment, an adhesive, and the like are mixed, on a surface of high-quality paper/medium-quality paper and that has higher smoothness than the plain paper. Here, the plain paper, the rough paper, and the coated paper are verified. However, smoothness (kind) of paper that can be determined by an embodiment of the present invention is obviously not limited to this example.

FIG. 6 is a view illustrating a verification result with respect to a plurality of kinds of paper with substantially-identical grammage. In the verification result in FIG. 6, "heater rating," a "voltage applied to a heater (applied voltage)," a "state of a fixing device," a "duty ratio in standby," a "duty ratio in printing" of each kind of paper, and a "difference between duty ratios in printing and in standby" of each kind of paper are illustrated as items. In FIG. 6, a "difference between duty ratios in printing and in standby" is referred to as a "difference in printing and in standby." A duty ratio in standby is that of immediately after warming up is completed. The verification result includes, as items of an error, an "applied voltage" and a "state of a fixing device." Measurement is performed in a condition in which the "heater rating" is 200 V, the "applied voltages" are 180 V, 200 V, and 220 V, and the "states of a fixing device" are a first time in the morning, five minutes after the first time in the morning, and fifteen minutes after the first time in the morning.

As it can be understood from the verification result in FIG. 6, there is hardly a difference in a difference between the duty ratio in standby and the duty ratio in printing in each kind of paper even when a measurement condition (error) is changed. Further, a difference (average value) between the difference between duty ratios in printing and in standby of the plain paper and that of the rough paper is 10[%] and a difference (average value) between the difference between duty ratios in printing and in standby of the plain paper and that of the coated paper is −9[%]. From this result, in a case where grammage is substantially identical, it is possible to specify a kind of paper when a duty ratio in standby and a duty ratio in printing are known.

In the verification result in FIG. 6, in a case where the plain paper is standard paper, it is possible to determine that paper to be determined is the coated paper when the lighting rate B (reference lighting rate A+9) ('9' is example of first value) is satisfied. Further, when the lighting rate B (reference lighting rate A−10) ('10' is example of second value) is satisfied, it is possible to determine that paper to be determined is the rough paper. The first and second values are examples. For example, the first value may be set to '8' and the second value may be set to '9' by utilization of the lowest value in the verification result. An equal sign '=' is an example and it is possible to arbitrarily determine whether there is an equal sign.

The above determination expression varies depending on standard paper. For example, in a case where the rough paper is the standard paper, setting may be performed in such a manner that paper to be determined is the plain paper when (reference lighting rate A+10)≤ the lighting rate B<(reference lighting rate A+19) is satisfied and that paper to be determined is the coated paper when the lighting rate B (reference lighting rate A+19) is satisfied.

[Verification Result (Plurality of Piece of Plain Paper with Different Grammage)]

Then, a lighting rate (duty ratio) of the heater 35 in a case of performing printing on a plurality of pieces of plain paper with different grammage will be verified. Lighting rates (duty ratio) of plain paper with grammage being 80 g/m$^2$ and plain paper with grammage being 120 g/m$^2$ are measured. Here, pieces of plain paper with grammage being 80 g/m$^2$ and 120 g/m$^2$ are verified. However, a kind of paper or grammage that can be determined by an embodiment of the present invention is obviously not limited to this example.

FIG. 7 is a view illustrating a verification result with respect to a plurality of pieces of plain paper with different grammage.

In the verification result in FIG. 7, a difference in the difference (average value) between duty ratios in printing and in standby between two pieces of plain paper with different grammage is 27%. Based on this result, it is possible to detect a difference in grammage since differences between duty ratios in standby and in printing vary greatly when the grammage is different.

In the verification result in FIG. 7, in a case where the plain paper with grammage being 80 g/m$^2$ is standard paper, when the lighting rate B≥(reference lighting rate A+27) ('27' is example of third value) is satisfied, it is possible to determine that paper to be determined is in a grammage band different from that of set paper.

[Effect of First Embodiment]

According to the first embodiment configured in the above manner, it is possible to determine information related to paper based on lighting rates X and B of the heater 35 in standby and in printing which rates are determined by the heater lighting control unit 110. More specifically, the paper determination unit 120 can compare the reference lighting rate A (estimated value) that is an estimated lighting rate of the heater 35 in printing with the lighting rate B of the heater 35 in printing, which rate is determined by the heater lighting control unit 110, and can determine smoothness or the like of paper housed in the paper feed tray 21 based on a result of the comparison. Thus, it is possible to constantly detect information related to paper (such as smoothness) accurately with a simple configuration without providing an extra measurement device regardless of a state of the fixing device 30.

<2. Second Embodiment>

Next, as the second embodiment, an example of determining information related to paper by using power consumption of a heater in standby and in printing in an arbitrary period instead of using a lighting rate of the heater will be described.

Figure 8:
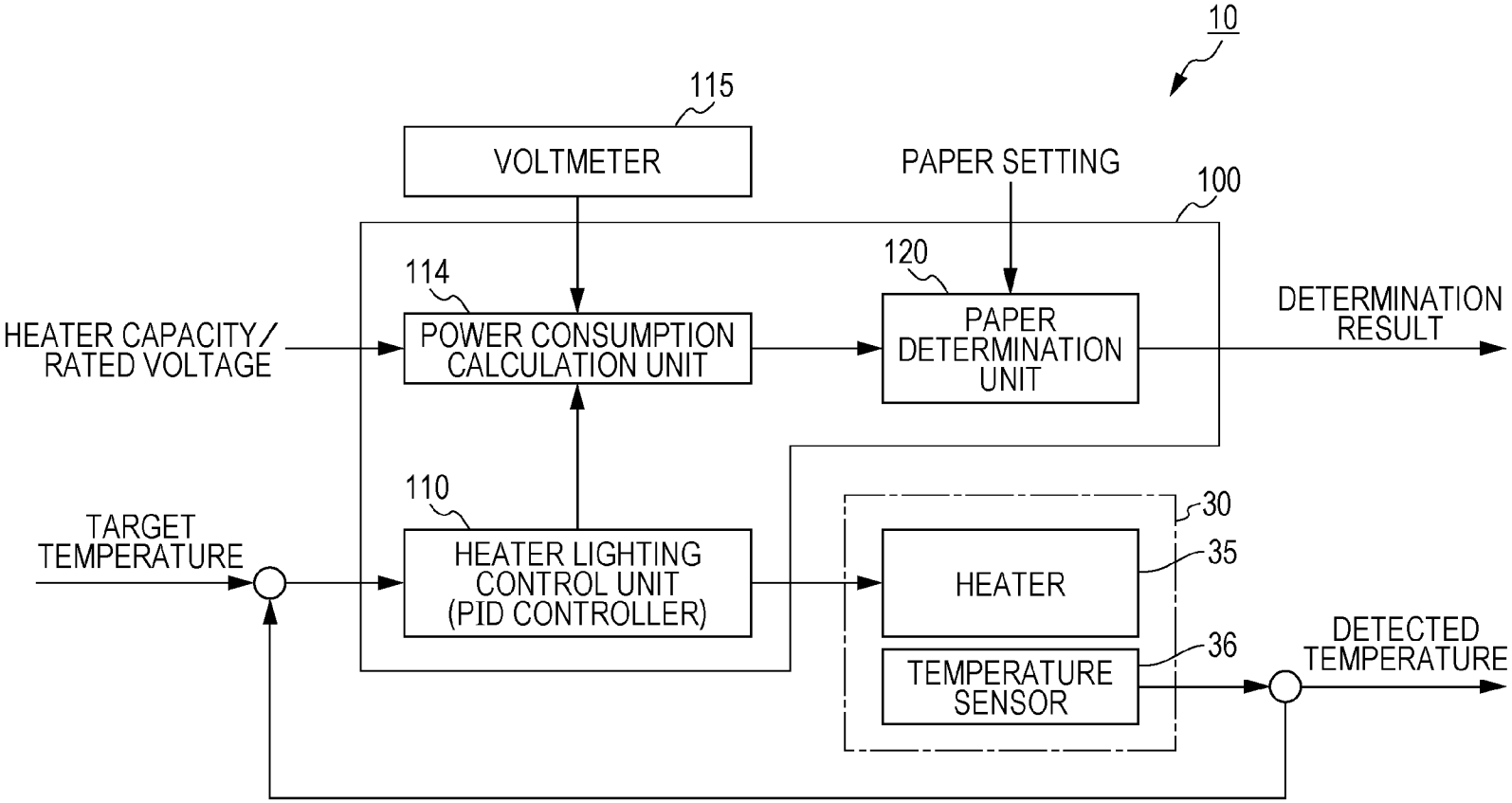
FIG. 8 is a block diagram illustrating a flow of heater lighting control and paper detection control in a control device according to a second embodiment.

FIG. 8 is a block diagram illustrating a flow of heater lighting control and paper detection control in a control device according to a second embodiment. The block diagram in FIG. 8 is different from the block diagram in FIG. 3 in a point that an image forming device 10 includes a power consumption calculation unit 114 and a voltmeter 115 (example of voltage measurement unit).

The power consumption calculation unit 114 (example of heater power consumption calculation unit) calculates power consumption of a heater 35 based on a voltage that is applied from a heater drive circuit 102 to the heater 35 and that is measured by the voltmeter 115 (measured voltage), a lighting rate of the heater 35 which rate is determined by a heater lighting control unit 110, a heater capacity, and a rated voltage. The power consumption is calculated by utilization of an expression (3). A prescribed period in the expression (3) means a certain predetermined period. Note that similarly to the first embodiment, lighting control of the heater 35 is performed by on/off control or hysteresis control other than PID control.

$$\text{Power consumption}=(\text{heater capacity}\times(\text{measured voltage}/\text{heater rated voltage})\hat{}1.55)\times\text{lighting rate}\times\text{prescribed period}/3600 \quad (3)$$

A paper determination unit 120 determines information related to paper by using power consumption of the heater in standby and in printing. That is, reference power consumption that is estimated power consumption of the heater in printing (estimated value) and power consumption calculated based on a lighting rate of the heater in printing which rate is determined by the heater lighting control unit 110 are compared with each other and smoothness or the like of paper housed in a paper feed tray is determined based on a result of the comparison. Then, contents determined in the paper determination unit 120 (determination result) is fed back to a control parameter of a control device 100.

According to the second embodiment configured in the above manner, it is possible to determine information related to paper based on power consumption of the heater 35 in standby and in printing. More specifically, the paper determination unit 120 can compare reference power consumption that is estimated power consumption of the heater 35 in printing and power consumption calculated based on a lighting rate B of the heater 35 in printing, which rate is determined by the heater lighting control unit 110, and can determine smoothness or the like of paper housed in a paper feed tray 21 based on a result of the comparison. Thus, it is possible to constantly detect information related to paper (such as smoothness) accurately with a relatively simple configuration regardless of a state of a fixing device 30 although the voltmeter 115 is necessary.

<3. Third Embodiment>

Next, as the third embodiment, an example of changing a control parameter of heater lighting based on a result of determination by a paper determination unit 120 will be described.

In a case where the paper determination unit 120 (FIG. 3, FIG. 4, and FIG. 8) determines that grammage of standard paper and grammage of paper housed in a paper feed tray 21 are different from each other greatly, the paper determination unit 120 (or control device 100) changes a set value of a target temperature and performs adjustment in such a manner that adhesiveness optimal to paper is acquired. Here, when grammage of paper is higher than that of standard paper, a target temperature is increased. When grammage of paper is lower than that of standard paper, a target temperature is decreased.

Here, a control device 100 may display, on an LCD 51 of an operation display unit 50, that information related to paper housed in a paper feed tray 21 is different from paper setting. Moreover, the control device 100 may perform a display prompting a user to give an instruction for reprinting. Furthermore, in a case of changing a target temperature (condition in printing), a control device 1 may perform a display on the LCD 51 that a condition is to be changed and may perform a display prompting a user to select reprinting. A similar display may be performed in each of fourth to sixth embodiments described later.

According to the third embodiment, based on a result of the determination by the paper determination unit 120, a heater lighting control unit 110 can properly perform lighting control of the heater 35 according to paper by changing a target temperature (condition in printing) for determination of a heater lighting rate.

Further, a user can realize that paper setting and paper housed in a paper feed tray 21 are different by looking at a display on the operation display unit 50. Accordingly, it is possible to perform correct paper setting with respect to paper housed in the paper feed tray 21. Further, a user can give an instruction for reprinting by using paper setting with which it is possible to acquire adhesiveness optimal to paper.

<4. Fourth Embodiment>

Next, as the fourth embodiment, an example in which an image forming device 10 includes a unit of setting grammage of paper in detail with input operation of a user and controls separation of paper after fixation according to a result of determination of paper will be described.

Figure 9:
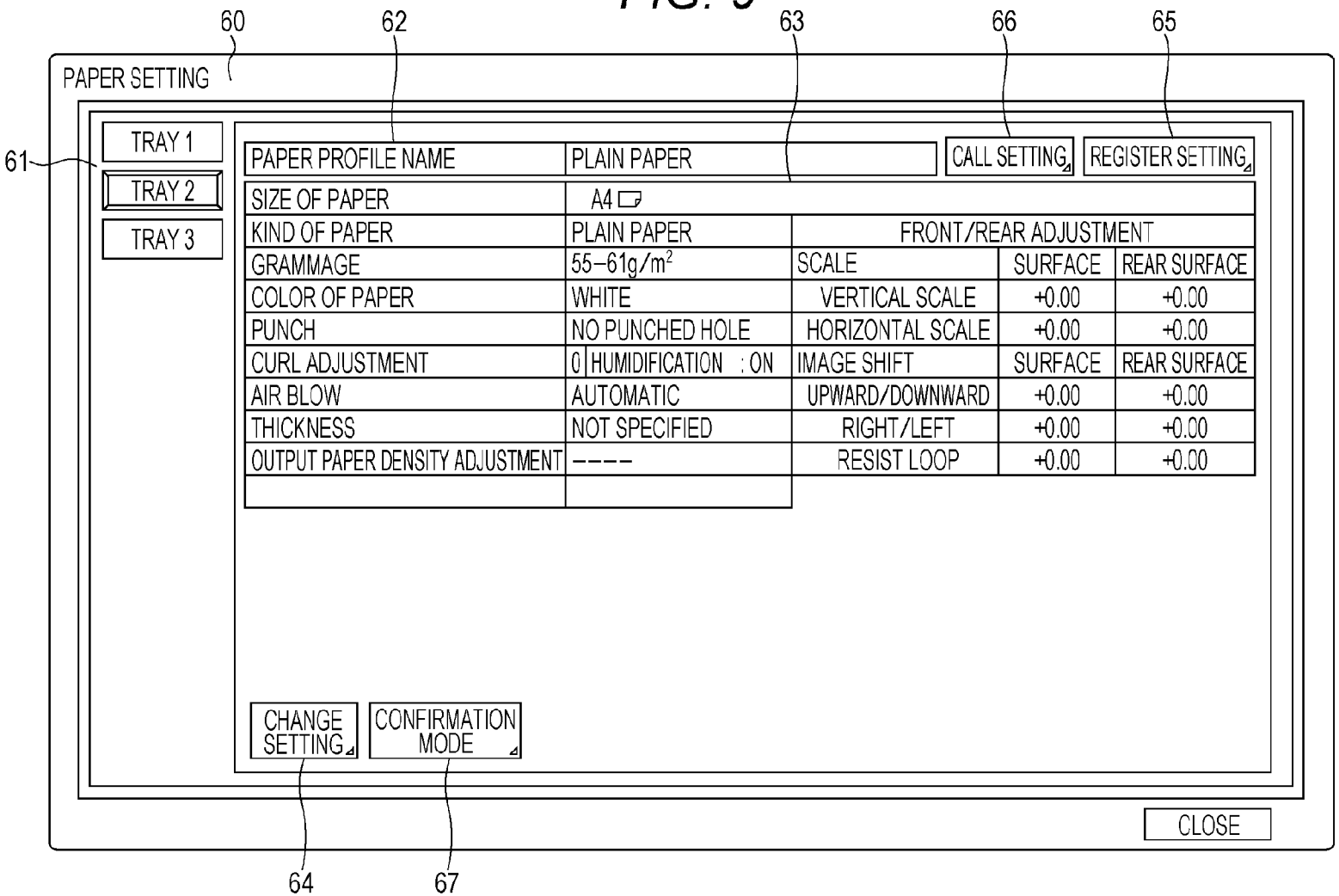
FIG. 9 is a view illustrating an example of a user interface for paper setting according to a fourth embodiment.
Figure 10:
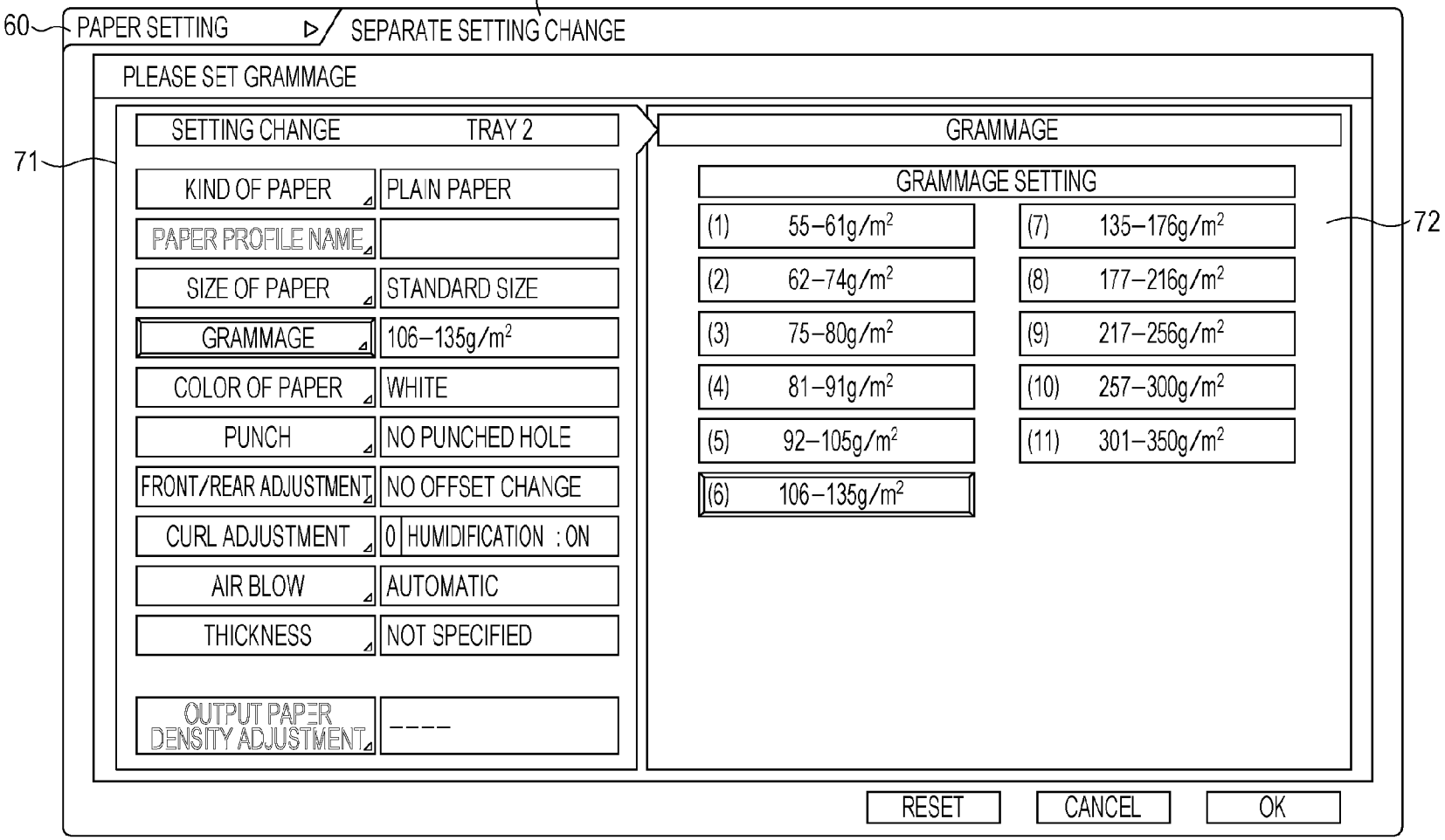
FIG. 10 is a view illustrating an example of a user interface for a separate setting change according to the fourth embodiment.

FIG. 9 is a view illustrating an example of a user interface for paper setting according to a fourth embodiment. FIG. 10 is a view illustrating an example of a user interface for a separate setting change according to the fourth embodiment.

A control device 100 displays a paper setting screen 60 (example of paper setting unit) in FIG. 9 on an LCD 51 of an operation display unit 50 by predetermined operation of a user. On the paper setting screen 60, a paper feed tray selecting part 61, a paper profile name 62, detailed setting contents 63, a setting changing button 64, a setting registration button 65, a setting calling button 66, and a confirmation mode button 67 are displayed. In an example in FIG. 9, setting contents of a tray 2 is displayed. When detecting that the setting changing button 64 is operated, the control device 100 displays, as a child page of the paper setting screen 60, a separate setting changing screen 70 in FIG. 10.

On a left side of the separate setting changing screen 70 (example of paper setting unit), a setting change item 71 is displayed. In the setting change item 71, a plurality of setting items is prepared. Currently, grammage is selected. On a right side of the separate setting changing screen 70, a user interface to set a detail of a setting item selected in the setting change item 71 is displayed. Currently, a grammage setting part 72 to set grammage in detail is displayed. In the grammage setting part 72, eleven stages of grammage from (1) to (11) are prepared and a user can perform detailed grammage setting by selecting any stage of the grammage.

For example, when an OK button is operated after grammage and a paper profile name are set on the separate setting changing screen 70, the paper setting screen 60 is displayed again. Then, when the setting registration button 65 is operated on the paper setting screen 60, a paper profile with a set name is registered into a storage device 101. The registered paper profile can be called by operation on the setting calling button 66.

According to the fourth embodiment, in a case where the image forming device 10 includes a unit with which a user can set grammage of paper in detail, it is possible to detect information related to paper such as smoothness more accurately. Thus, it is possible to feed a more accurate control parameter back to the control device 100.

Figure 11:
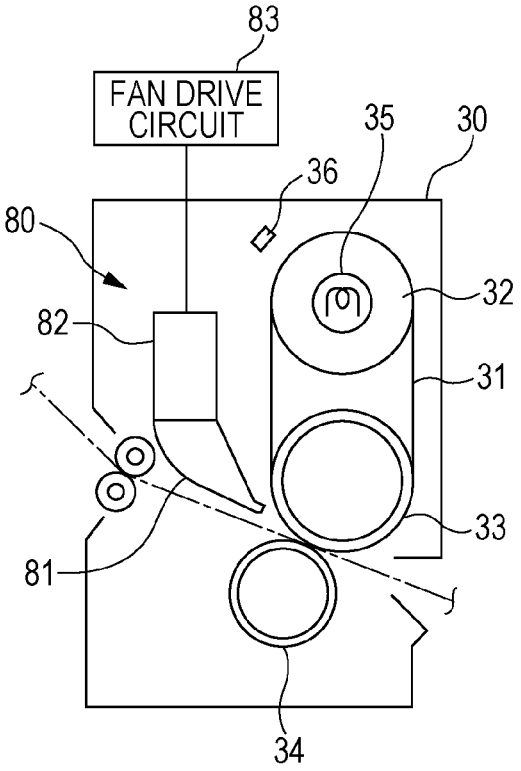
FIG. 11 is a view illustrating a configuration example of a fixing device, which includes an air separation device, according to the fourth embodiment.

FIG. 11 is a view illustrating a configuration example of a fixing device including an air separation device according to the fourth embodiment.

An air separation device 80 includes a duct 81, a blower fan 82 to blow air, and a fan drive circuit 83 that supplies a drive signal to the blower fan 82 under control by the control device 100. The duct 81 is arranged on a downstream side in a paper carrying direction of an upper pressure roller 33 and blows the air, which is blown from the blower fan 82, toward a fixing nip part formed by the upper pressure roller 33 and a lower pressure roller 34.

When the paper determination unit 120 determines that smoothness of paper housed in a paper feed tray 21 is higher than that of standard paper, the control device 100 automatically corrects separation of the paper by increasing the number of rotations of the blower fan 82. The control device 100 outputs, to the fan drive circuit 83, a control signal with which the number of rotations of the blower fan 82 becomes larger than a reference value. The blower fan 82 receives a drive signal from the fan drive circuit 83 and the number of rotations becomes larger than the reference value. Thus, strong air is blown from the duct 81 and the air is blown to paper passing through a fixing nip part of a fixing device 30, whereby separation of the paper is improved.

In the example in FIG. 11, a feedback of a more accurate control parameter with respect to air separation is given to the control device 100. Thus, separation of paper after fixation in the image forming device 10 is kept and quality of an image formed on the paper is secured.

<5. Fifth Embodiment>

Next, as the fifth embodiment, an example of controlling a toner deposition amount on paper according to a result of determination of the paper will be described.

Figure 12:
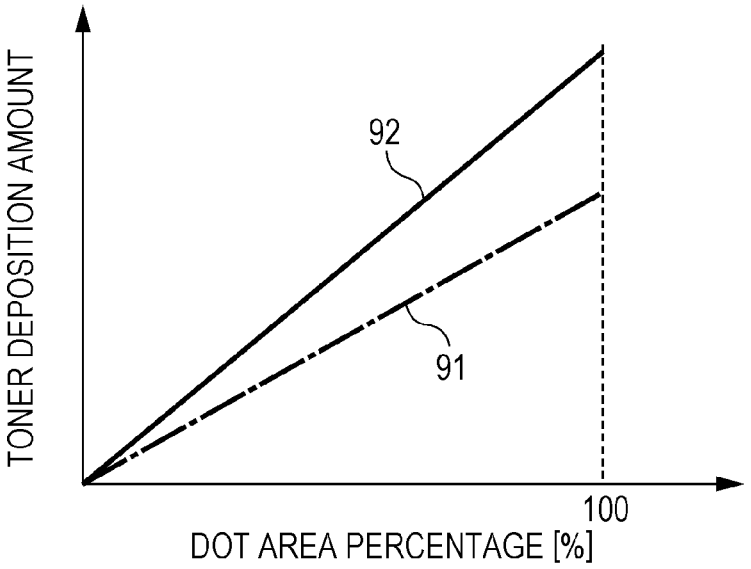
FIG. 12 is a graph illustrating an example of a toner deposition amount property according to a fifth embodiment.

FIG. 12 is a graph illustrating an example of a toner deposition amount property according to the fifth embodiment. Data of a toner deposition amount property is stored in a storage device 101 or an ROM.

In a case where a paper determination unit 120 determines that smoothness of paper housed in a paper feed tray 21 is lower than smoothness of standard paper, a control device 100 performs correction of increasing a toner deposition amount on the paper compared to a case of the standard paper. For example, in a case where paper is rough paper having smoothness lower than that of the standard paper (plain paper), when printing is performed with setting of a normal toner deposition amount, a density of an image formed on the paper is low since toner easily soaks into the rough paper. Thus, in order to prevent soaking, a toner deposition amount (toner density) with respect to the same dot area percentage is increased as illustrated in FIG. 12. In FIG. 12, a toner deposition amount in the whole dot area percentage is increased by correction of a toner deposition amount property from a straight line 91 to a straight line 92.

The control of a toner deposition amount is performed, for example, by adjustment of a charged amount in a charging unit or an amount of toner supplied from a developing device to a photoreceptor drum. By the control of a toner deposition amount, a density of a toner image formed on the photoreceptor drum is adjusted. In a case of paper with low smoothness, a toner deposition amount is increased by an increase in a charged amount and/or a toner amount. In a case of paper with high smoothness, a toner deposition amount is decreased by a decrease in a charged amount and/or a toner amount. Alternatively, it is also possible to control a toner deposition amount on paper by adjusting a transfer bias applied to a secondary transfer roller of a secondary transfer unit 18.

Here, similarly to the third embodiment, the control device 100 may display, on an LCD 51 of an operation display unit 50, that information related to paper housed in a paper feed tray 21 is different from paper setting. Moreover, the control device 100 may perform a display prompting a user to give an instruction for reprinting.

According to the fifth embodiment, with respect to a toner deposition amount, it is possible to give a feedback of a more accurate control parameter to the control device 100. Thus, a toner density in image forming is kept and quality of an image formed on paper is secured.

<6. Sixth Embodiment>

In a case where smoothness of paper is low, that is, a case where paper is rough, a stain, a blot, or the like (smear) is likely to be generated due to fixation failure on the paper. Thus, in the sixth embodiment, in order to prevent a smear, a temperature condition of a lower pressure roller 34 is controlled according to a result of determination of paper.

Figure 13:
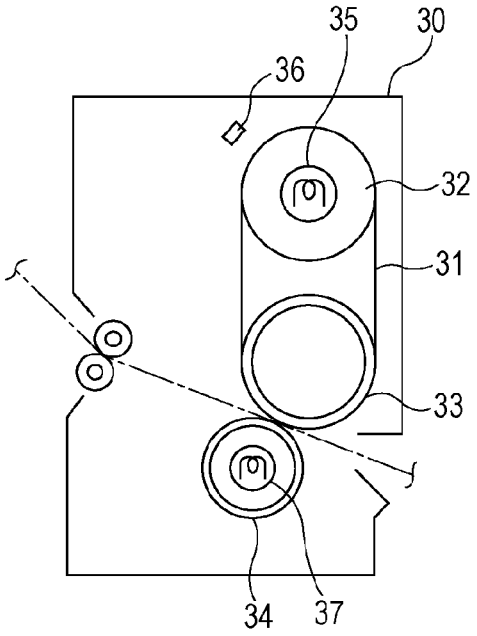
FIG. 13 is a view illustrating a configuration example of a fixing device, which includes a lower pressure roller including a heater, according to a sixth embodiment.

FIG. 13 is a view illustrating a configuration example of a fixing device 30, which includes a lower pressure roller 34 including a heater, according to the sixth embodiment. The lower pressure roller 34 includes a heater 37. The heater 37 is turned on/off based on a drive signal supplied by a heater drive circuit 102. The heater 37 may include a configuration similar to that of the heater 35.

In a case where a paper determination unit 120 determines that smoothness of paper housed in a paper feed tray 21 is less than smoothness of standard paper, a control device 100 controls a lighting rate of the heater 37 and performs correction of making a temperature condition of the lower pressure roller 34 higher than that in a case of the standard paper.

According to the sixth embodiment, it is possible to give the control device 100 a feedback of a more accurate control parameter with respect to a temperature condition of the lower pressure roller 34. Thus, adhesiveness is kept and quality of an image formed on paper is secured.

<7. Seventh Embodiment>

Next, as the seventh embodiment, an example of automatically registering a printing condition optimal to paper into a paper profile based on a result of determination of the paper in a case where a paper profile creating function is installed in an image forming device 10 will be described.

The paper profile creating function is a function with which a user can register often-used paper setting as a paper profile. The paper profile is created on a paper setting screen 60 or a separate setting changing screen 70. As one of the paper profile creating function, there is a paper profile confirmation mode. In the paper profile confirmation mode, correction (recreation) of a paper profile is performed based on a result of determination of paper housed in a paper feed tray 21.

Figure 14:
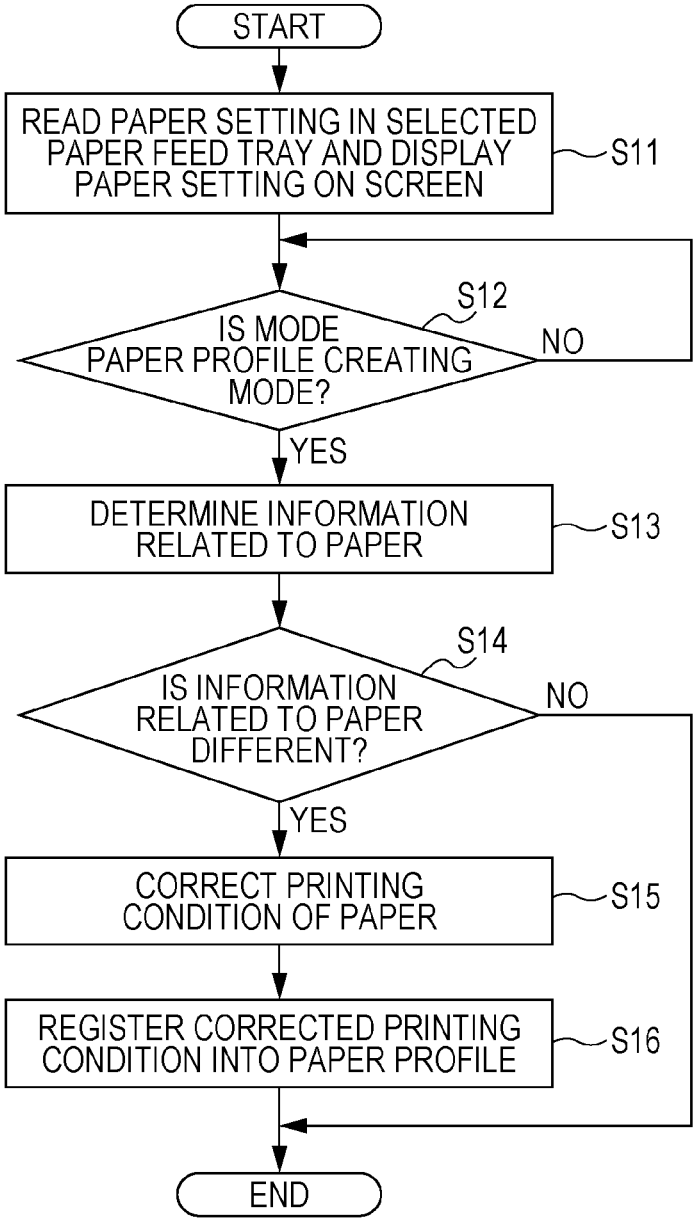
FIG. 14 is a flowchart illustrating an example of paper profile creating processing according to a seventh embodiment.

FIG. 14 is a flowchart illustrating an example of paper profile creating processing according to the seventh embodiment. It is assumed that a paper profile corresponding to paper is previously set in a storage device 101 before the paper profile creating processing. For example, setting and registration of a paper profile are performed in shipment from a factory or installation of an image forming device or are performed by a user with operation on the paper setting screen 60 or the separate setting changing screen 70.

First, a control device 100 displays the paper setting screen 60 according to operation by a user. Then, the control device 100 reads, from the storage device 101, paper setting (paper profile) in a paper feed tray 21 selected on the paper setting screen 60 and displays the setting on a screen (S11).

Then, the control device 100 determines whether a mode is a paper profile creating mode (S12). This can be determined by determination whether a confirmation mode button 67 is operated. When the confirmation mode button 67 is not operated (NO in S12), it is kept monitored whether the confirmation mode button 67 is operated.

When the confirmation mode button 67 is operated in the determination processing in step S12 (YES in S12), a paper determination unit 120 of the control device 100 determines information related to paper housed in a corresponding paper feed tray 21 (smoothness or grammage) based on a job (S13).

Then, the paper determination unit 120 determines whether a parameter of paper setting (paper profile) in the paper feed tray 21 and a parameter of paper housed in the paper feed tray 21 are different (S14). When the two parameters are identical (NO in S14), the control device 100 ends the paper profile creating processing.

On the other hand, when the two parameters are different in the determination processing in step S14 (YES in S14), the control device 100 sets an optimal printing condition (image forming condition) of paper based on a parameter of the paper and corrects a printing condition of the paper profile (S15). As a printing condition optimal to paper, for example, a developing condition, a transfer condition, a fixing condition, and the like are corrected. The developing condition is, for example, a toner deposition amount with respect to a dot area percentage. Further, the transfer condition is, for example, a transfer bias. The fixing condition is, for example, a target temperature of a heater 35 or an amount of air for air separation.

Then, the control device 100 registers the corrected printing condition into a paper profile and updates the paper profile (S16). With this processing, a paper profile on which a printing condition optimal to paper is reflected is created for a corresponding paper feed tray 21. After this processing is over, the control device 100 ends the paper profile creating processing.

The control device 100 executes the paper profile creating processing before execution of a job and executes the job by using the updated paper profile. Alternatively, the control device 100 performs a printing operation by using an already-existing paper profile with respect to one or a plurality of pages in a job and performs the printing operation by using an updated paper profile with respect to a subsequent page.

According to the seventh embodiment, it is possible to set a printing condition optimal to paper and to register the condition into a paper profile based on a result of determination (smoothness or grammage) by the paper determination unit 120 in a case of creating (confirming) a paper profile. Thus, it is possible to form an image on paper by using a printing condition optimal to the paper.

<8. Other>

In each of the above-described first to seventh embodiments, an example in which an image forming device 10 includes a fixing device 30 has been disclosed. However, the fixing device 30 may be formed separately from an image forming device. In this case, a configuration in which a control unit having a function equivalent to that of a control device 100 is provided in an external fixing unit and operations of the fixing unit and the image forming device are controlled based on a result of determination of paper which determination is performed by the control unit of the fixing unit may be included.

Further, in each of the above-described first to seventh embodiments, a configuration in which a fixing device 30 heats an upper pressure roller 33 via a fixing belt 31 has been described. However, a configuration in which a fixing belt 31 is not included and an upper pressure roller 33 includes a heater may be included.

Moreover, the present invention is not limited to each of the above-described embodiments. It is obvious that various other application examples and modification examples can be made within the spirit and the scope of the invention described in claims.

For example, each of the above-described embodiments is what describes a configuration of a device and a system specifically in detail to make it easier to understand a description of the present invention and is not limited to what includes all configurations described above. Further, it is possible to replace a part of a configuration of an embodiment with a configuration of a different embodiment. Further, it is possible to add a configuration of a different embodiment to a configuration of an embodiment. Further, it is possible to perform addition/deletion/replacement of a different configuration with respect to a part of a configuration of each embodiment.

Further, in each of the above-described embodiments, an information determination processing function or the like with respect to paper is realized by software when a calculation processing device interprets and executes a program that realizes the function. However, a part or a whole of each of the above-described configurations, functions, processing units, processing means, and the like may be realized by hardware, for example, by designing as an integrated circuit.

Further, a control line or information line considered to be necessary for a description is illustrated and not all control lines or information lines of a product are necessarily illustrated. Actually, it is considered that almost all configurations are mutually connected.

Further, in the present description, processing steps describing processing in time series not only include processing performed in time series in the described order but also include processing that is not necessarily processed in time series and that is executed in parallel or separately (such as parallel processing or processing by object).

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device comprising:

an image forming unit configured to form an image on paper fed from a paper housing unit;

a heater lighting control unit configured to determine, based on a temperature detected by a temperature detecting unit in a fixing unit at least including a fixing roller that holds and carries the paper on which the image is formed, a pressure roller arranged in pressure-contact with the fixing roller, a heater that heats the fixing roller, and the temperature detecting unit arranged in a vicinity of the heater, a lighting rate of the heater; and a paper determination unit configured to determine information related to the paper based on lighting rates of the heater in standby and in printing which rates are determined by the heater lighting control unit, wherein the paper determination unit compares a reference lighting rate, which is a lighting rate of the heater in printing estimated based on the lighting rate of the heater in standby and setting of grammage with respect to the paper housing unit, with the lighting rate of the heater in printing which rate is determined by the heater lighting control unit, and determines smoothness as the information related to the paper based on a result of the comparison.

2. The image forming device according to claim 1, wherein the paper determination unit determines that smoothness of the paper is higher than reference smoothness in a case where the lighting rate of the heater in printing is higher than the reference lighting rate of the heater in printing, and determines that smoothness of the fed paper is lower than the reference smoothness in a case where the lighting rate of the heater in printing is lower than the reference lighting rate of the heater in printing.

3. The image forming device according to claim 2, wherein the paper determination unit determines that the paper is a first kind of paper with high smoothness in a case where the lighting rate of the heater in printing is higher than the reference lighting rate of the heater in printing for a first value or more, and determines that the paper is a second kind of paper with low smoothness in a case where the lighting rate of the heater in printing is lower than the reference lighting rate of the heater in printing for a second value or more.

4. The image forming device according to claim 1, wherein the paper determination unit determines that grammage set with respect to the paper housing unit and grammage of the paper are different from each other in a case where the lighting rate of the heater in printing and the reference lighting rate of the heater in printing are different from each other for a third value or more.

5. The image forming device according to claim 4, wherein when the paper determination unit determines that the grammage of the fed paper is different from setting of the grammage with respect to the paper housing unit, a target temperature of the heater is changed.

6. The image forming device according to claim 5, further comprising a display unit configured to display a screen of changing a condition in printing in a case where the condition in printing is changed based on a result of the determination of smoothness of the paper performed by the paper determination unit.

7. The image forming device according to claim 1, wherein the fixing unit further includes a blower fan configured to blow air to paper passing through a nip part formed by the fixing roller and the pressure roller, and an amount of the air blown from the blower fan is changed according to a result of the determination of smoothness of the paper performed by the paper determination unit.

8. An image forming device comprising:

an image forming unit configured to form an image on paper fed from a paper housing unit;

a heater lighting control unit configured to determine, based on a temperature detected by a temperature detecting unit in a fixing unit at least including a fixing roller that holds and carries the paper on which the image is formed, a pressure roller arranged in pressure-contact with the fixing roller, a heater that heats the fixing roller, and the temperature detecting unit arranged in a vicinity of the heater, a lighting rate of the heater;

a paper determination unit configured to determine information related to the paper based on lighting rates of the heater in standby and in printing which rates are determined by the heater lighting control unit; and a paper setting unit configured to set grammage with respect to the paper housing unit by input operation of a user.

9. An image forming device comprising:

an image forming unit configured to form an image on paper fed from a paper housing unit;

a heater lighting control unit configured to determine, based on a temperature detected by a temperature detecting unit in a fixing unit at least including a fixing roller that holds and carries the paper on which the image is formed, a pressure roller arranged in pressure-contact with the fixing roller, a heater that heats the fixing roller, and the temperature detecting unit arranged in a vicinity of the heater, a lighting rate of the heater; and a paper determination unit configured to determine information related to the paper based on lighting rates of the heater in standby and in printing which rates are determined by the heater lighting control unit, wherein a toner deposition amount on the paper in the image forming unit is changed according to a result of the determination of smoothness of the paper performed by the paper determination unit.

10. An image forming device comprising:

an image forming unit configured to form an image on paper fed from a paper housing unit;

a heater lighting control unit configured to determine, based on a temperature detected by a temperature detecting unit in a fixing unit at least including a fixing roller that holds and carries the paper on which the image is formed, a pressure roller arranged in pressure-contact with the fixing roller, a heater that heats the fixing roller, and the temperature detecting unit arranged in a vicinity of the heater, a lighting rate of the heater;

a paper determination unit configured to determine information related to the paper based on lighting rates of the heater in standby and in printing which rates are determined by the heater lighting control unit; and a heater configured to heat the pressure roller, wherein a temperature condition of the heater configured to heat the pressure roller is changed according to a result of the determination of smoothness of the paper performed by the paper determination unit.

* * * * *